United States Patent [19]

Gunners et al.

[11] 4,213,393

[45] Jul. 22, 1980

[54] GUN PROJECTILE ARRANGED WITH A BASE DRAG REDUCING SYSTEM

[76] Inventors: Nils-Erik Gunners, Furudalsvägen 10, 13700 Västerhaninge; Rune V. Hellgren, Södermannagatan 18, 11623 Stockholm; Torsten Liljergren, Sandavägen 28, 14032 Grodinge, all of Sweden

[21] Appl. No.: 816,184

[22] Filed: Jul. 15, 1977

Related U.S. Application Data

[63] Continuation-in-part of Ser. No. 755,634, Dec. 30, 1976, abandoned, which is a continuation of Ser. No. 624,236, Oct. 20, 1975, abandoned.

[51] Int. Cl.[2] ..... F42B 13/20

[52] U.S. Cl. ..... 102/49.3; 102/49.7; 102/100; 149/108.6

[58] Field of Search ..... 102/38 R, 38 A, 49.3, 102/49.7, 61, 87, 100; 149/19.2

[56] References Cited

U.S. PATENT DOCUMENTS

| | | | |
|---|---|---|---|
| 3,018,203 | 1/1962 | Guth | 149/19.9 |
| 3,224,191 | 12/1965 | Bratton | 102/100 |
| 3,494,285 | 2/1970 | Doris, Jr. et al. | 102/87 |
| 3,628,457 | 12/1971 | Magnusson et al. | 102/49.3 |
| 3,698,321 | 10/1972 | Wall | 102/49.3 |
| 3,754,507 | 8/1973 | Dillinger et al. | 102/52 |
| 3,886,009 | 5/1975 | Puchalski | 102/49.3 |
| 3,988,990 | 11/1976 | MacDonald, Jr. | 102/87 |
| 4,003,313 | 1/1977 | Puchalski | 102/87 |
| 4,091,732 | 5/1978 | Schadow | 102/49.3 |

FOREIGN PATENT DOCUMENTS

| | | |
|---|---|---|
| 510303 | 9/1920 | France . |
| 147104 | 6/1921 | United Kingdom . |
| 1037743 | 8/1966 | United Kingdom . |
| 1221203 | 2/1971 | United Kingdom . |
| 1286723 | 8/1972 | United Kingdom . |
| 1373405 | 11/1974 | United Kingdom . |

*Primary Examiner*—Stephen C. Bentley

*Attorney, Agent, or Firm*—Burns, Doane, Swecker & Mathis

[57] ABSTRACT

A gun-launched projectile with a chamber for generation of combustion gases from a propellant grain is disclosed. The chamber is arranged with at least one gas outlet in its base plane, said propellant grain having a burning area, mass and static burning rate so related with the area of the gas outlet/outlets, that a low mass flow of gaseous combustion product is operable to continue from the time of muzzle exit for a considerable portion of projectile flight and to provide a substantial decrease in base drag with a concomitant increase in projectile range. The pressure in the combustion chamber during flight only slightly exceeds the base pressure in an amount of 0.01 to 0.5 bar.

3 Claims, 6 Drawing Figures

Fig. 1
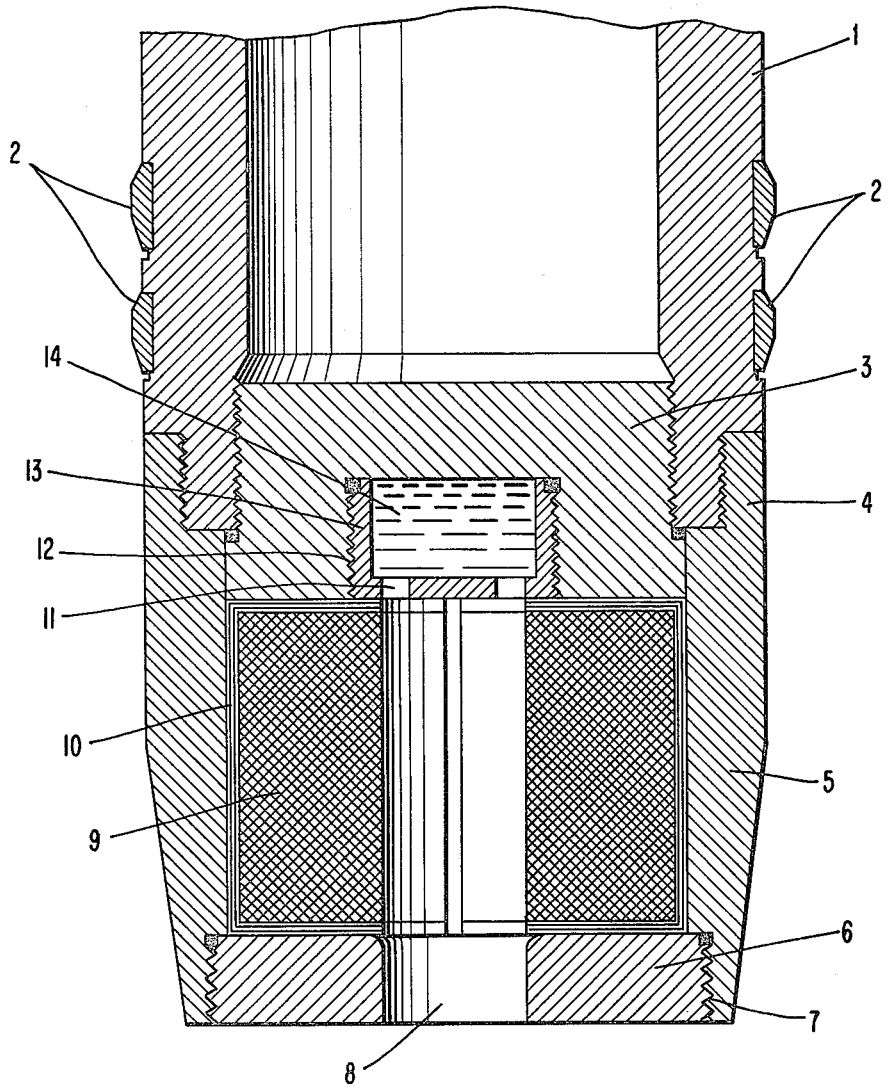
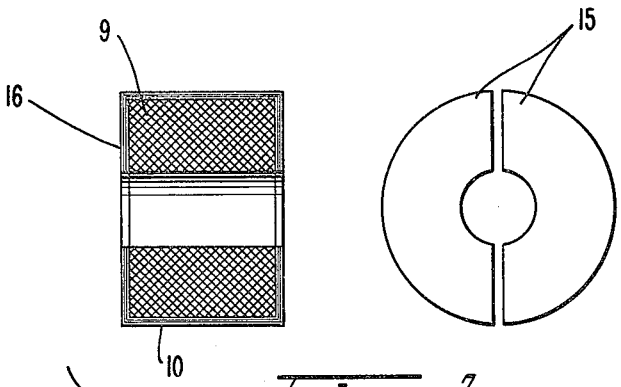
Fig. 2

Fig. 5
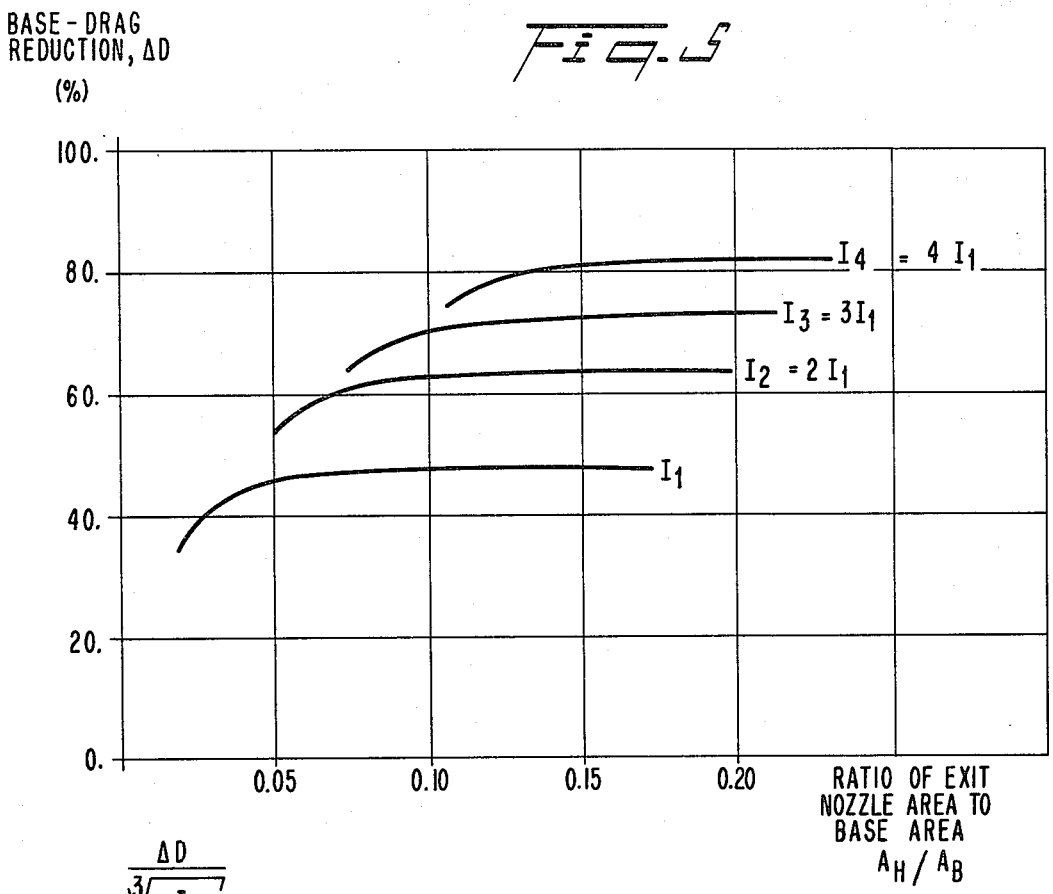
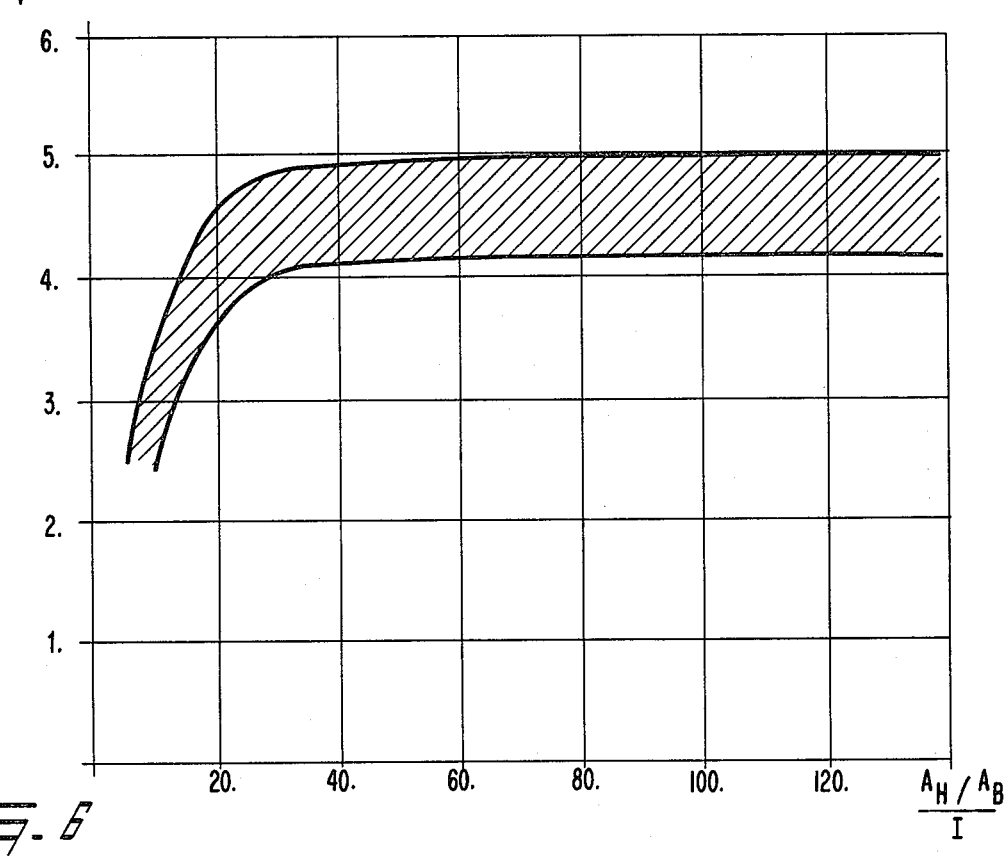
Fig. 6

GUN PROJECTILE ARRANGED WITH A BASE DRAG REDUCING SYSTEM

REFERENCE TO RELATED APPLICATIONS

This application is a continuation-in-part of our parent application Ser. No. 755,634, filed Dec. 30, 1976, now abandoned which application in turn is a continuation of our patent application Ser. No. 624,236, filed Oct. 20, 1975, now abandoned and relates to improvements in or relating to artillery projectiles arranged with a base drag reducing system.

BACKGROUND OF THE INVENTION

The invention concerns a projectile with a unit decreasing the base drag of the projectile and in the case of a gun launched projectile increases the range and decreases dispersion.

In order to increase the range of artillery projectiles, it has been suggested to arrange a rocket propulsion motor at the rear part of the projectile, thus creating what are generally known as RAP projectiles. However, the RAP system has a number of known disadvantages, since even minor changes in ignition time and rocket power cause considerable changes in range. It is difficult to control the exact point of ignition of the rocket charge which concomitantly causes difficulty in controlling the trajectory of the projectile. RAP-projectiles, even when seemingly otherwise similar and fired from the same point, land in a relatively widely dispersed area.

In order to overcome the disadvantages encountered with rocket propulsion assisted artillery projectiles, an alternative method has been suggested, namely, to reduce the base drag acting on the projectile during the trajectory. An artillery projectile in flight forms a low pressure area immediately behind the projectile which creates a force (commonly called "base drag") which lessens the velocity of the projectile. This method is a completely different approach to the problem, since no rocket assisting effect is achieved.

Base drag contributes generally to a relatively large part of the total drag and depends upon the fact that the base pressure due to the resulting wake flow in the base region is lower than the ambient air pressure. By ejecting a mass flow from the base region of the body into the near wake the flow pattern can be affected in such a way that the base pressure is increased and thereby the base drag is reduced. If the ejection of mass is combined with liberation of heat, e.g. by combustion, the base pressure can be further increased.

The above-mentioned effect, the base flow/burning effect, differs from rocket propulsion foremost therein that the reaction force caused by the base flow is very small as compared to the decrease in drag due to increased base pressure. In order to efficiently utilize the base flow effect the base mass flow should occur during a considerable part of the flight time.

Small caliber (e.g., about 30 mm. or less) projectiles have been equipped with tracer or fumer compositions which provide some relief to the base drag problems with these types of projectiles. See, for example, U.S. Pat. No. 3,086,009. These systems, however, burn relatively rapidly (usually for only a few seconds) and cannot be controlled to provide prolonged relief for longer times. Tracer or fumer compositions are generally solid, relatively inflexible compositions which also contain relatively high amounts of metals (e.g., about 35%) and thus produce a gas containing high amounts of solid combustion particles which do not provide relief to the base drag problem. Also, these systems are most often applicable to small caliber (e.g., about 30 mm or less), short range (e.g., about 4000 m., often about 300–400 m.) projectiles, although proposals for use with larger caliber projectiles have been made.

The problem with respect to base drag of a rocket motor and means for relieving base drag are disclosed in U.S. Pat. No. 3,885,385.

Generating the necessary base mass flow involves, e.g., in the case of a moving projectile, certain practical problems. The ejected mass has to be supplied from some system carried by the projectile.

Until the present invention, however, no satisfactory solution has been found for counteracting the effects of base drag on artillery projectiles.

The object of the present invention is to provide artillery projectiles arranged with a base drag reducing system, having a number of previously unknown features optimizing the achievable flight range and decreasing dispersion. This object has been achieved by a combination of certain design features relating to the projectile, and in particular the rear portion of the projectile, with an eminently suitable type of fuel and igniter charge.

In the present invention, the projectile for gun launching through a muzzle and having decreased base drag characteristics comprises a projectile body having a base including restricted gas outlet nozzle means and wall means interiorly of the projectile body which define a combustion chamber communicating with the gas outlet nozzle means. The projectile of the present invention also comprises base drag reduction means (including the combustion chamber, nozzle and propellant grain means of a fuel rich compostion located in the combustion chamber and presenting a burning area operable to be ignited upon exit from the muzzle of the gun) for ejecting a controlled low mass flow of gas into and liberating heat in the near wake zone of the body to increase the base pressure in the near wake zone and decrease the base drag of the gun projectile without rocket propulsion by exceeding ambient pressure in the wake zone. The exit area of the restricted outlet nozzle, the burning area and mass of the propellant and the static burning rate of the propellant are so related that the low mass flow of gas is operable to continue from the time of muzzle exit for a considerable portion of projectile flight and also that in flight the pressure in the combustion chamber only slightly exceed the pressure at the base in an amount of 0.01 to 0.5 bar. The combustion chamber is generally provided with an igniter system operable to maintain the ignition of the propellant upon exit from the muzzle.

In addition, total area of the base ($A_b$), the area of the restricted gas outlet nozzle ($A_h$) and the dimensionless mass flow rate of the ejected gas (I) has the ratio $$\frac{A_h/A_b}{I}$$

of at least 10 at the muzzle.

The characteristics of the invention, devices, aspects and advantages will become apparent from the following description.

DESCRIPTION OF THE DRAWINGS

FIG. 1 is a longitudinal section of the aft part of an artillery projectile, FIG. 2 is a longitudinal section and an end view of one type of grain configuration, FIG. 5 is a graph showing base drag reduction as a function of the size ratio of the nozzle outlet to the total base area, FIG. 6 is a graph showing the results of the data of FIG. 5 expressed in relation to the said size ratio of the nozzle outlet to total base area and the dimensionless mass flow.

DETAILED DESCRIPTION OF THE INVENTION

Figure 3:
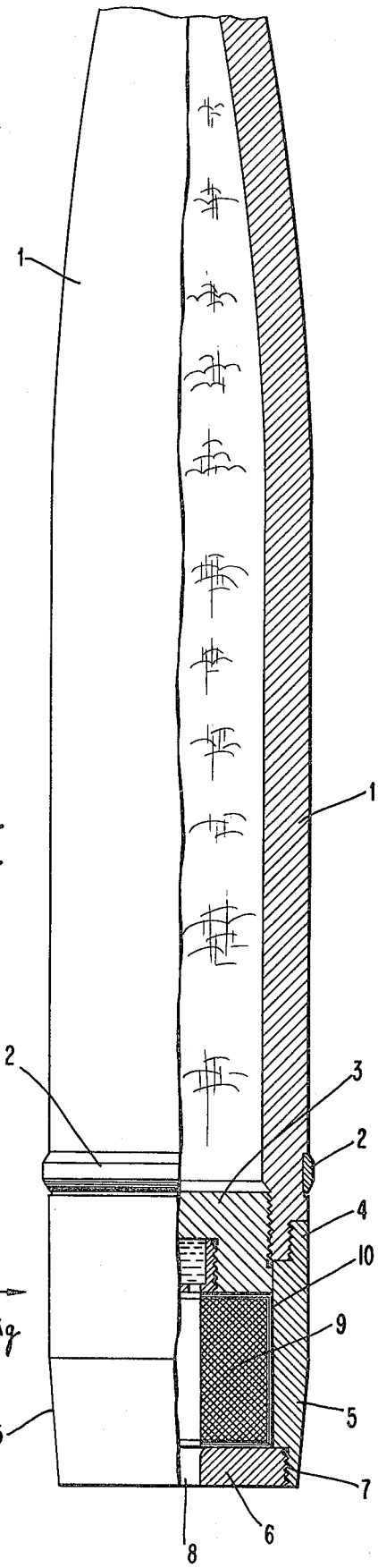
FIG. 3 is a longitudinal section of an artillery projectile.

With reference to the embodiment shown in FIG. 1, the artillery projectile shell 1 is arranged with conventional driving bands 2 and an end wall 3. The shell 1 is joined to a tubular housing 5 by means of a screw thread generally indicated as 4 and a base plate 6 is joined to the rear portion of the housing 5, also by means of a screw thread generally indicated as 7. The base plate 6 is arranged with one or more openings 8 having a specific size relative to the burning area of the propellant grain (charge) 9 as hereinafter described, which may initially be closed by means of a breakable protective foil, e.g., aluminum tape or foil. The tubular housing 5 acts as a combustion chamber in which a propellant grain 9 is arranged, preferably arranged with a a combustion inhibitor 10 covering the envelope and end surfaces of the propellant grain 9. A number of holes 11 are arranged in an igniter housing 13 attached to and embraced by the end wall 3 and an igniter charge 14 is arranged in said housing 13.

It is of great importance that the propellant is ignited and the ejection of mass and liberation of heat starts immediately at the muzzle since the drag is highest during the first part of the trajectory. For ignition, electric squibs or mechanical igniters triggered by the acceleration forces of launch might be used. The ignition can, however, be simplified by using the high temperature combustion gases in the gun tube. It is, however, not sufficient that these combustion gases ignite the propellant grain since the propellant may be extinguished due to the steep pressure drop in the combustion chamber of the base flow unit when the projectile leaves the muzzle (e.g., from about 600 bar to 1 bar). For this reason a sustaining igniting system is necessary. In a very advantageous design of the base flow, use has been made of an igniter system based upon a pyrotechnic composition with very low sensitivity to pressure variations.

The pyrotechnic igniter consists of a composition which during combustion forms mainly solid products and is similar to known fumer compositions. If the amount of gaseous products is very low the igniter should be placed very close to the propellant surface. The pyrotechnic igniter may consist of two or more layers of different compositions where one of these has a higher content of gas forming compounds.

When firing the gun, the propellant in the base flow unit as well as the pyrotechnic composition are ignited by the combustion gases in the gun barrel. The pyrotechnic igniter will immediately reignite the propellant after the projectile has left the muzzle. A suitable pyrotechnic igniter composition, preventing extinguishment of the igniter due to the pressure drop at the muzzle, comprises a composition of 49.5% zirconium hydride, 49.5% lead dioxide and 1% organic binder although any other suitable igniter composition known in the art may also be utilized.

A more complete view of an artillery projectile is shown in FIG. 3 in which the numerals correspond to those used in FIG. 1.

The pressure in the combustion chamber should be so chosen that it only slightly, in most cases in the order of 0.01 to 0.5 bar, exceeds the base pressure. This results in a low burning rate of the propellant and a sufficiently low mass flow rate to accomplish an efficiently working system with long burning time. The low combustion pressure, resulting in a subsonic gas flow, also decreases the temperature sensitivity as compared to rocket motor conditions.

The momentum of the exhausting gases in a system in accordance with the invention is low and therefore the force of reaction on the body (projectile) will be negligible as compared to the drag.

As a consequence of the low total mass flow required for an efficient base flow unit, the unit will be of low weight and volume. For gun launched projectiles, base flow units of ordinary size have been shown to have a higher efficiency than rocket motors (RAP) with the same amount of propellant. In order to withstand the high mechanical stresses and strains induced in the propellant grain in a projectile, due to acceleration during launch and due to the rotation of the projectile, the propellant should have a high ultimate strain. Composite propellants, e.g. with polybutadiene as a binder and ammonium perchlorate as oxidizer have suitable mechanical properties. Composite propellants are, of course, well known in that art and are composed of a rubbery-type of binder (or fuel) such as polybutadiene in which an oxidizer such as ammonium perchlorate is mixed. While the specific amounts of each component can be varied and the resulting physical characteristics will also vary, the particular composition used in the gun-launched projectile of the present invention should be sufficiently strong that it does not break under the shock load applied when the gun is fired yet not be so flexible as to detrimentally deform under this load. Gun launched projectiles are subject to high shock loads upon firing as well as high rotational forces during flight which forces are significantly different from those applied to a rocket at firing and in flight. However, the choice of a particular propellant composition for use in the present invention is within the skill of the artisan. The propellant should be capable of burning at a static pressure down to about 0.1 bar.

The stresses and strains may be reduced by giving the propellant grain a suitable configuration in which case a less elastic propellant can be used, e.g., a double base propellant with nitrocellulose. If the grain is cylinder or tube shaped the stresses and strains can be reduced by cutting the grain in segments.

The ejected mass flow as a function of time should be decreasing since the projectile velocity and the density of the ambient air are decreasing. A degressive mass flow is achieved by the propellant grain configuration and by inhibiting certain of its surfaces.

One way which makes it possible to achieve different degressive mass flows and also different burning times is to divide a tube grain in a smaller or greater number of segments with the outer envelope surface and the end surfaces inhibited. By dividing the grain in this way is also the above mentioned risk for crack formation due to centrifugal forces decreased.

FIG. 2 illustrates suitable propellant grain configurations in which the grains are divided in two segments 15 and the outer envelope surfaces and end surfaces are covered by inhibitor.

In a typical gun projectile as shown in FIG. 1, the total mass of the projectile is 18.5 kg while the mass of the propellant grain is in this case only 0.330 kg. The length of the grain is 57 mm, its outer diameter 76 mm and its inner diameter 25 mm. The nozzle in the base plate has the diameter 25 mm. To achieve a desirable degressive mass flow from the burning propellant, the grain is divided in two segments whereby the initial burning area becomes 93 $cm^2$ and the burning area at the end of the burning time 66 $cm^2$. This gives the ratio 19 and 13 respectively between the burning area and the total nozzle outlet area (4.9 $cm^2$) at the beginning and end of the burning time.

By providing a conventional 105 mm gun projectile with a base flow unit of described type and size and with a composite propellant containing 85% ammonium perchlorate and 15% polybutadiene a total range increase of 25% was achieved of which 12% was due to the base flow effect and the rest was due to the weight increase of 2 kg. caused by the base flow unit. With a propellant grain weighing only 0.300 kg, and consisting of 75% ammonium perchlorate and 25% polybutadiene, a further total range increase of 26% was achieved. The higher range increase is a consequence of the use of a more fuel rich propellant (i.e., higher polybutadiene content), resulting in a higher degree of afterburning in the near wake zone at the projectile base. With a 120 mm gun projectile having a somewhat greater base flow unit an increase in range of 25% resulting only from the base flow effect has been achieved. In order to achieve a favourable range increase, it is suitable to have an ammonium perchlorate content of 50–90%. A propellant mass of from about 0.8 to 2 kg is used to achieve a high degree of base drag reduction with 155 mm projectiles while a propellant mass of from about 0.1 to 0.2 kg is used for 75 mm projectiles.

When using fuel rich propellants, it is convenient to use base plates with several nozzles having the same total area. With such an arrangement a more efficient afterburning in the near wake zone is achieved.

The invention is not restricted to applications where the combustion chamber is placed in the aft part of the projectile. The chamber can be placed anywhere in the projectile if it only communicates with the projectile base and the nozzle area is matched to the burning area and to the burning rate of the propellant. By propellant is here understood compositions which chemically or mechanically contain oxidizer. The propellant grain can consist of more or less energy rich propellant which requires somewhat different ratios between burning area and nozzle area. Known composite rocket propellants can be used with advantage. Fuel rich propellants are preferred.

The present use of hollow base artillery projectiles makes it possible to increase the trajectory range in a simple way. A fuel rich propellant charge together with a suitable igniter composition can be inserted as one unit in the hollow base structure, held in position by a base plate having one or a number of gas outlet nozzles. The base plate can be arranged with an external screw thread and a corresponding internal thread is cut in the rear portion of the hollow base structure. Due to the low burning pressure for the propellant charge, chosen to exceed the base pressure by only 0.01 to 0.5 bar, the inside wall of the hollow base structure in the projectile need not be reinforced. It should also be emphasized that the present volume in the projectile for the high explosive charge remains intact, i.e., no reduction in the size of the explosive charge is necessary. This fact should be considered when comparing the artillery projectile according to the present invention with RAP-projectiles, which have a considerably larger weight, require a larger volume of space and, since the combustion chamber is closed in the gun barrel, an increased case thickness to withstand the high gun pressure and acceleration forces.

The base drag reducing effect can be further optimized by utilizing a boat tail angle in the range of from 0° to 6° depending on size and efficiency of the unit. Reduction of the boat tail angle has always been desirable, since a reduction of the boat tail angle improves stability during trajectory and makes it possible to use longer projectiles with less wave drag and larger range. However, due to the increase in base drag for conventional projectiles when using a small bost tail angle, it has been necessary to use a larger boat tail angle (i.e., in the range of from 6° to 9°) in order to achieve a favorable flight range.

Figure 4:
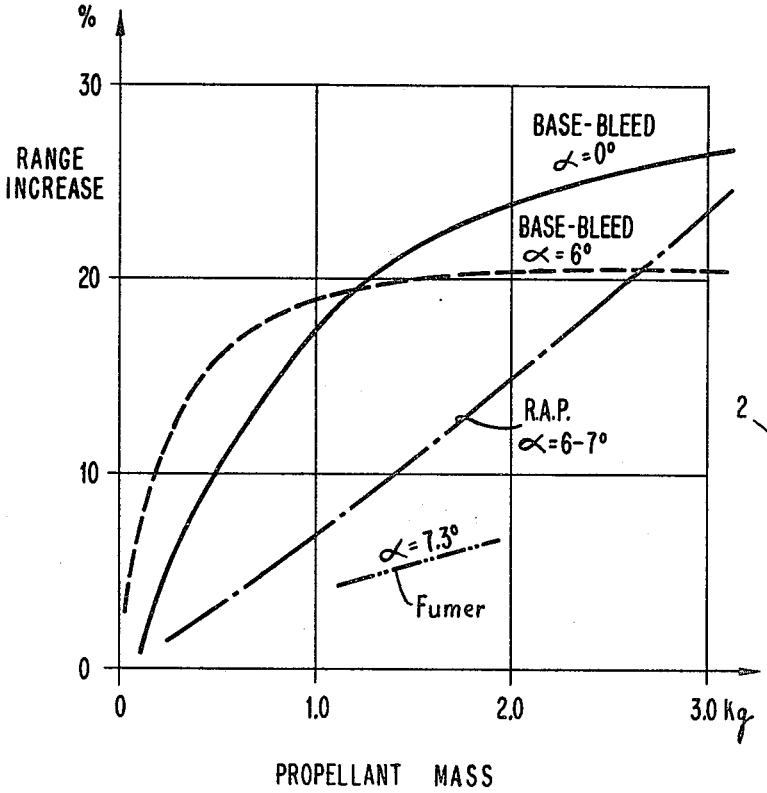
FIG. 4 is a graph showing range increase as a function of propellant mass and boat tail angle.

FIG. 4 is a graph of the range increase achieved with increasing propellant for otherwise comparable projectiles. The dot-dash line is a RAP (rocket-assisted projectile), having a boat tail angle of 6° to 7°, the dotted line is a projectile of the present invention having a boat tail angle of 6°, the solid line is a projectile of the present invention having a boat tail angle of 0° and the dash-double dot line is a fumer-equipped projectile having a boat tail angle of 7.3°. The advantageous increases in range for the projectiles of the present invention are quite apparent. It is further apparent that while the projectile of the present invention having a boat tail angle of 6° has substantially increased range than the fumer and also the RAP-projectile (at least up to about 2.6 kg mass), the projectile of the present invention having a boat tail angle of 0° has even greater increase in range as the propellant mass increases above about 1.1 kg.

Apart from the improved stability during trajectory, reduction of the boat tail angle also makes it possible to use a propellant charge with a larger diameter, i.e., a larger size. However, the size of the propellant charge should not be chosen for a maximum burning time, but for a maximum range. Generally the burning time will be over a considerable portion (e.g., at least about 30%) of projectile flight. Ordinarly, burning time for maximum range is about 50% of the trajectory. However, it will be understood that burning time is designed for maximum range of that caliber and burning time may be greater than 50% of the trajectory when the projectile range is less than maximum. The effect of base flow burning is neglible after this point and when considered in connection with the additional weight and volume of the propellant charge, which also reduces the effective volume for the high explosive charge, maximum range is usually achieved when the size of the propellant charge is restricted to a maximum buring time of about 50% of the trajectory (although the size can be designed to give a burning range in excess of 50% of the trajectory, e.g., up to about 60% of projectile flight).

The housing for the propellant charge can advantageously be manufactured from aluminum or similar low density materials, thus further reducing the weight of the base flow part of the projectile. If desired, the combustion chamber can be manufactured from steel in combination with an inside lining of aluminum or other low density material.

In order to obtain maximum efficiency for the base drag reducing effect, the total mass flow should be determined as a function of nozzle outlet area relative to the propellant burning area. That is, at the gun muzzle, the ratio of propellant burning area to nozzle outlet area has a value of from about 10:1 to 80:1, preferably from about 15:1 to 45:1. It has been found that the maintenance of this relationship is desirable to controlling the mass flow of the gas and obtaining the proper base drag reduction during flight of the artillery projectile. If the hole is too small, pressure builds up inside the combustion chamber resulting in a rocket-assist to the projectile rather than the desired base bleed effect. To avoid that this happens at high altitude, the burning area should be degressive, so that the above-mentioned ratio does not exceed about 20:1 at burn-out of the propellant. It has been shown that by using a propellant the burning rate of which is of the order of 1.5 mm/s at the pressure of 1 bar, the ratio of burning area to nozzle area should not exceed 50:1 to avoid rocket motor conditions in which case the burning time decreases and the mass flow increases to a great extent. On the other hand, if the nozzle outlet area is too large, the remaining base wall may be insufficient to provide support for the propellant grain under the loads applied and undesirable deformation may occur. In addition, in this situation the propellant charge is insufficient to sustain a flow of combustion products for a long enough time to counteract base drag over a sufficiently long enough portion of the trajectory of the artillery projectile. The effect, in the latter situation, is somewhat similar to the effects of tracer or fumer materials discussed above.

Thus the use of a nozzle outlet having a size in relation to the total burning area within the range as given above is essential to obtain the benefits and advantages of the present invention. In this connection it should be emphasized, that the object of the propellant charge is not to create any effect comparable with the effect of a rocket motor, i.e., to cause an additional reaction force or thrust acting on the projectile in the direction of the trajectory, but merely to arrange for a low pressure flow of mainly gaseous combustion products, thus reducing the base drag acting on the projectile during trajectory. The artillery projectile according to the present invention can therefore not be compared with rocket motor assisted artillery projectiles.

It is also essential to the proper operation of the gun launched projectile of the present invention that the various parameters be controlled in a manner sufficient to obtain maximum base drag effect. That is, the exit area of the outlet nozzle, the burning area and mass of the propellant grain in the combustion chamber and the static burning rate of the propellant grain should be so related that a low mass flow of gas sufficient to provide the desired base bleed effect in the near wake zone of the projectile is continuous from the time of nozzle exit for a considerable portion of the projectile flight. The exit area of the outlet nozzle and mass of the propellant have been discussed above. The burning area of the propellant is determined by the size and configuration of the propellant grain, which are also discussed above. The burning rate is a function of the propellant composition and is generally in the range of from 0.7 to 1.5 mm/second at a static pressure of 1 bar.

The mass flow rate of the exiting gas is a function of a number of factors and may be expressed as dimensionless mass flow rate. Dimensionless mass flow rate (I) is defined as $$I = \frac{m_h}{\int \infty \, \mu\infty \, A_b}$$

in which $m_h$ is mass flow through the restricted gas outlet nozzle, $\int \infty$ is the density of the surrounding atmosphere, $\mu\infty$ is flight speed and $A_b$ is the total area of the base of the projectile. The ratio of the area of the nozzle outlet ($A_h$) to the total area of the base of the projectile ($A_b$) differs for a given mass flow. The higher the mass flow, the higher the $A_h/A_b$ ratio must be to obtain the maximum base drag reduction.

FIG. 5 is a graph of tests made to show the base drag reduction ($\Delta D$) achieved in relation to $A_h/A_b$ ratio with each curve representing a different dimensionless mass flow rate (I) which was maintained constant for each curve. As may be seen from these graphs, for each constant I, an increase in the $A_h/A_b$ ratio resulted in a maximum base drag reduction at a particular point and the base drag reduction remained essentially constant thereafter. Thus, by a proper choice of I and $A_h/A_b$, a maximum base drag reduction can be obtained.

FIG. 6 is a graph in which all of the curves of FIG. 5 are superimposed. This graph was obtained by plotting for the data used to prepare the curves of FIG. 5, the relationship of the ratio $$\frac{A_h/A_b}{I} \text{ to } \frac{\Delta D}{\sqrt[3]{I}}$$

in which $\Delta D$ is the base drag reduction. The expression of the base drag reduction in terms of its value divided by the cube root of I has been found to be necessary to compress the data from differing values of I into one, essentially superimposed curve. As may be seen from this graph, the maximum base drag reduction is obtained when the ratio $$\frac{A_h/A_b}{I}$$

is at least 10 and generally at least about 20. A higher ratio $$\frac{A_h/A_b}{I}$$

does not result in any significantly higher base drag reduction.

The main advantages of the gun-launched projectile of the present invention when compared with RAP-projectiles are as follows:

(a) A considerably improved trajectory range for a given propellant mass;

(b) Improved stability, since a speed increase during trajectory does not take place;
(c) Decreased ballistic dispersion;
(d) Easy adaption to projectiles having a hollow base structure;
(e) Possibility to use low density materials with low tensile strength due to the low pressures in the combustion chamber;
(f) Minimum space required for base flow unit (Examples: To achieve equal range increase for 155 mm projectile, a propellant mass of 2.6 kg used in a RAP-projectile would equal 1.2 kg used in a projectile according to the present invention, i.e., the space occupied by about 1.5 kg of explosives);
(g) The reduced boat tail angle makes it possible to use a propellant charge with increased diameter and reduced depth;
(h) The use of aluminum, wholly or partly, in the combustion chamber moves the center of gravity forward, thus giving room for a larger and more effective charge. The combustion chamber can have greater length and be bigger than otherwise possible, thus resulting in a larger charge.

The advantages set forth above when compared with the existing rocket assisted propulsion projectiles are given as an example of the features achievable when utilizing an artillery projectile according to the present invention.

In addition, the present invention provides substantially increased performance as compared with a fumer-equipped projectile. The projectile of the present invention has a better base drag reduction (up to three times that obtainable with a fumer composition) since the system of the present invention provides hot gaseous combustion products which last for a longer period of the trajectory of the projectile and substantially increased range for the projectile due to the combined effects of the increased base drag reduction and longer burning times of the base flow unit of the present invention.

The artillery projectile according to the present invention is obviously not in any way restricted to the described embodiment, since many other embodiments are possible within the scope of the invention and the following claims.

What is claimed:

1. A projectile for gun launching through a muzzle and having decreased base drag characteristics comprising:

a projectile body presenting a base including restricted gas outlet nozzle means;

wall means interiorly of said projectile body defining combustion chamber means communicating with said gas outlet nozzle means;

base drag reduction means for ejecting controlled low mass flow of gas into and librating heat in the near wake zone of said body to increase the base pressure in said wake zone and decrease the base drag of the gun projectile without rocket assist propulsion;

said base drag reduction means including said combustion chamber means, said nozzle means and propellant grain means of a fuel rich composition located in said combustion chamber means and presenting a burning area operable to be ignited upon muzzle exit;

the exit area of said restricted outlet nozzle means, the burning area and mass of said propellant grain means in said combustion chamber means and the static burning rate of said propellant grain means being so related that said low mass flow of gas is operable to continue from the time of muzzle exit for a considerable portion of projectile flight, and that in flight the pressure in said combustion chamber only slightly exceeds the pressure at said base in an amount of 0.01 to 0.5 bar;

the total area of the said base ($A_b$), the area of the restricted gas outlet nozzle means ($A_h$) and the dimensionless mass flow rate of the ejected gas (I) being in the ratio $$\frac{A_h/A_b}{I}$$

and being at least 10 at the muzzle of the gun barrel.

2. The projectile of claim 1 wherein the said ratio is at least 20 at the muzzle of the gun barrel.

3. A projectile for gun launching through a muzzle and having decreased base drag characteristics comprising:

a projectile body presenting a base including restricted gas outlet nozzle means;

wall means interiorly of said projectile body defining combustion chamber means communicating with said gas outlet nozzle means;

base drag reduction means for ejecting controlled low mass flow of gas into and librating heat in the near wake zone of said body to increase the base pressure in said wake zone and decrease the base drag of the gun projectile without rocket assist propulsion;

said base drag reduction means including said combustion chamber means, said nozzle means and propellant grain means of a fuel rich composition located in said combustion chamber means and presenting a burning area operable to be ignited upon muzzle exit;

the exit area of said restricted outlet nozzle means, the burning area and mass of said propellant grain means in said combustion chamber means and the static burning rate of said propellant grain means being so related that said low mass flow of gas is operable to continue from the time of muzzle exit for a considerable portion of projectile flight, and that in flight the pressure in said combustion chamber only slightly exceeds the pressure at said base in an amount of 0.01 to 0.5 bar, the total area of said base, the area of restricted gas outlet nozzle means and the dimensionless mass flow rate of the ejected gas being in a ratio sufficient to obtain the essentially maximum base drag reduction.

* * * * *